US008544227B2

(12) United States Patent
Gullette

(10) Patent No.: US 8,544,227 B2
(45) Date of Patent: Oct. 1, 2013

(54) STRUCTURAL SUPPORT COLUMN WITH BASE EMBEDDED WITHIN A FOUNDATION AND METHOD OF FORMING

(76) Inventor: Jon Michael Gullette, Galveston, TX (US)

( * ) Notice: Subject to any disclaimer, the term of this patent is extended or adjusted under 35 U.S.C. 154(b) by 794 days.

(21) Appl. No.: 12/632,536

(22) Filed: Dec. 7, 2009

(65) Prior Publication Data

US 2010/0132292 A1 Jun. 3, 2010

Related U.S. Application Data

(63) Continuation-in-part of application No. 11/582,819, filed on Oct. 18, 2006, now Pat. No. 7,632,437.

(60) Provisional application No. 60/729,553, filed on Oct. 25, 2005.

(51) Int. Cl.
*E04C 3/34* (2006.01)
*E04G 21/02* (2006.01)

(52) U.S. Cl.
USPC ..... 52/295; 52/297; 52/741.14; 52/741.15; 52/745.17

(58) Field of Classification Search
USPC ..... 52/295, 296, 297, 741.14, 741.15, 52/745.17
See application file for complete search history.

(56) References Cited

U.S. PATENT DOCUMENTS

| | | | | | |
|---|---|---|---|---|---|
| 835,719 | A | * | 11/1906 | Westlake | 52/295 |
| 907,101 | A | * | 12/1908 | Boland | 52/295 |
| 975,135 | A | | 11/1910 | Kelsey et al. | |
| 986,957 | A | | 3/1911 | Wallin | |
| 1,033,916 | A | * | 7/1912 | McProud | 52/296 |
| 1,301,561 | A | * | 4/1919 | Hirschthal | 264/32 |
| 1,398,412 | A | | 11/1921 | Barkschat | |
| 1,591,796 | A | * | 7/1926 | Thompson | 52/296 |
| 1,627,754 | A | | 5/1927 | Townsend | |
| 2,093,346 | A | | 9/1937 | Badt | |
| 2,378,814 | A | | 6/1945 | Wascher | |
| 2,448,883 | A | * | 9/1948 | Hall | 249/51 |
| 2,975,498 | A | | 3/1961 | Plattner | |
| 3,108,403 | A | * | 10/1963 | Jackson | 52/297 |
| 3,184,893 | A | * | 5/1965 | Booth | 52/741.15 |
| 3,303,244 | A | * | 2/1967 | Talley et al. | 264/32 |
| 3,378,971 | A | | 4/1968 | Singer at al. | |
| 3,682,434 | A | | 8/1972 | Boenig | |
| 3,724,801 | A | | 4/1973 | Sels et al. | |
| RE27,732 | E | | 8/1973 | Van Buren | |
| 3,795,393 | A | | 3/1974 | Melfi | |
| 3,828,513 | A | | 8/1974 | Vanderklaauw | |

(Continued)

FOREIGN PATENT DOCUMENTS

| | | | |
|---|---|---|---|
| GB | 2 056 538 | | 3/1981 |
| JP | 402252832 | A | 10/1990 |
| JP | 403260264 | A | 11/1991 |
| JP | 405033491 | A | 2/1993 |

*Primary Examiner* — Michael Safavi

(74) *Attorney, Agent, or Firm* — Bushman & Associates, P.C.

(57) ABSTRACT

A structural support system includes one or more generally vertically extending columns of curable material wherein each column defines an outer column periphery. A base of curable material is preferably monolithically formed with the column on its lower portion. In one embodiment, the base may have an outer periphery that increases or varies along the base and wherein a foundation of curable material is formed over at least a portion of the base whereby the column, the base, and the foundation are mechanically locked together to resist lateral, torsional, and/or upwardly directed vertical forces.

19 Claims, 4 Drawing Sheets

(56) References Cited

U.S. PATENT DOCUMENTS

| | | | | | |
|---|---|---|---|---|---|
| 4,083,526 | A | | 4/1978 | Hatfield | |
| 4,424,951 | A | | 1/1984 | Spencer | |
| 4,627,211 | A | * | 12/1986 | Foster, Jr. | 52/741.15 |
| 4,673,157 | A | * | 6/1987 | Wells | 249/51 |
| 4,749,165 | A | | 6/1988 | Moraca | |
| 4,783,935 | A | * | 11/1988 | Creager | 52/295 |
| 4,918,891 | A | * | 4/1990 | Gerszewski | 52/295 |
| 5,255,888 | A | | 10/1993 | Workman | |
| 5,785,459 | A | * | 7/1998 | Swinimer | 52/296 |
| 5,800,727 | A | * | 9/1998 | Croghan | 249/51 |
| 5,890,333 | A | * | 4/1999 | Boroviak | 52/745.17 |
| 5,909,984 | A | | 6/1999 | Matthews | |
| 6,027,094 | A | | 2/2000 | Tian | |
| 6,151,851 | A | | 11/2000 | Carter | |
| 6,513,291 | B2 | * | 2/2003 | Gilsdorf | 52/297 |
| 6,543,742 | B2 | * | 4/2003 | Wells | 249/51 |
| 6,840,491 | B2 | * | 1/2005 | Swinimer | 249/51 |
| 6,865,859 | B2 | | 3/2005 | Flathau | |
| 7,131,240 | B2 | * | 11/2006 | Simmons | 52/297 |
| 2002/0152695 | A1 | * | 10/2002 | Gilsdorf | 52/297 |
| 2004/0093818 | A1 | * | 5/2004 | Simmons | 52/295 |
| 2004/0244667 | A1 | | 12/2004 | Veazey | |
| 2005/0186034 | A1 | | 8/2005 | Hall | |

* cited by examiner

STRUCTURAL SUPPORT COLUMN WITH BASE EMBEDDED WITHIN A FOUNDATION AND METHOD OF FORMING

This application is a continuation-in-part of U.S. patent application Ser. No. 11/582,819 filed Oct. 18, 2006, which is incorporated herein by reference in its entirety, and which claims benefit of U.S. Provisional Application No. 60/729,553, filed Oct. 25, 2005, which is also incorporated herein by reference in its entirety.

BACKGROUND OF THE INVENTION

1. Field of the Invention

The present invention relates generally to structural supports and, more particularly, to structural supports with increased lateral and torsional strength and methods for making the same.

2. Description of the Prior Art

Structural supports may be formed from a curable material, such as cementitious materials, i.e., cement, concrete, resins, polymeric materials, and/or other suitable materials. The uncured material is poured into a form until the material cures and hardens to produce the support, e.g., a vertical column. The structural supports may range in height from less than a foot to in excess of 20-30 feet. Typically, the structural support may comprise reinforcing materials such as steel, steel cables, reinforcing bars (rebar), and the like for the purpose of adding strength and durability to the final structure.

The structural supports can be of many different cross-sectional shapes, some of which were discussed in my previous applications referenced above and hereinafter. The structural supports can be used as supports for buildings, bridges, homes, and/or large facilities having innate structural needs.

In many cases, structural supports, such as columns may be built directly upon a cement slab, foundation, or the like. In such cases after being poured and cured, the structural support rests on the foundation. Thus, while the foundation supports vertically downwardly directed forces, the curable material in the foundation by itself provides relatively little support for lateral, torsional, or upwardly vertical forces which may act on the columns. Instead, reinforcements such as rebar are relied upon to provide this support.

However, it would be desirable to increase the lateral, torsional, and upwardly directed strength of structural supports provided by the foundation if it were possible to do so without increasing the cost or time required to build the structural supports.

The following U.S. patents describe various prior art systems that may be related to the above and/or other structural support systems:

U.S. Pat. No. 1,398,412, issued Nov. 29, 1921, to Barkschat, discloses a mold comprising a plurality of separable sections, each including longitudinally extending wooden members and segmental metal members extending transversely of and secured to the wooden members, the ends of the metal members on adjacent sections being in alignment when the sections are assembled to form the mold, and means for retaining the sections in assembled relation, including draw bars each pivotally connected at one end to one of the metal members and having its other end overlapping and detachably connected to the aligned metal member of the adjacent section.

U.S. Pat. No. 2,448,883, issued Sep. 7, 1948, to Hall, discloses, in a concrete post form construction, the combination of a base unit comprising a pair of facing sections each providing frusto-pyramidal shaped compartments which open to each other, strap means surrounding the sections to connect them together, the base unit having an upper facing socket therein of less depth than the compartment depth thereof, an upper post unit comprising a pair of sections having compartments facing each other, strap means surrounding the sections of the upper post unit and connecting them together, the sections of the upper post unit having a lower reduced end firmly seated at its lower margin in and upon the bottom of the socket of the base unit.

The present invention provides an improved structural support system and methods with increased lateral, torsional, and/or upwardly vertical strength at substantially the same time and cost. Accordingly, those of skill in the art will appreciate the present invention which addresses the above and/or other problems.

SUMMARY OF THE INVENTION

It is a general purpose of the present invention to provide an improved structural support system and method.

One possible object of the present invention is provide columns with improved strength to resist lateral, torsional, and/or upwardly vertical forces.

Another possible object of the present invention is to provide a base for a column which is shaped to interlock with a correspondingly shaped receptacle within a foundation.

Accordingly, the present invention provides a structural support system which may comprise elements such as a generally vertically extending column of curable material wherein the column defines an outer column periphery. A base of curable material is preferably monolithically formed with the column on its lower portion. In one embodiment, the base may have an outer periphery that varies in diameter with respect to the column outer periphery. In one possible embodiment, the outer periphery of the base may be angled with respect to the column periphery within a range from five degrees to twenty-five degrees.

A foundation of curable material may be formed over at least a portion of the base whereby the column, the base, and the foundation are mechanically locked together. In one possible embodiment, the structural support system may further comprise a mold for the base which is at least partially embedded within the foundation of curable material.

In one possible embodiment, a plurality of reinforcement members is mounted within the curable material within the foundation, the base, and the column. The plurality of reinforcement members may comprise interconnected reinforcement members which extend through the foundation, the base, and substantially along a length of the column.

In one possible embodiment, the foundation defines a receptacle which mates to at least a portion of the base to thereby interlock the foundation with the base.

The present invention may comprise a method for constructing a structural support comprising steps such as providing a generally vertically extending column of curable material wherein the column comprises a column periphery.

Other steps may comprise providing a base of curable material monolithically formed with the column on its lower portion, and providing that the base comprises an outer periphery that varies in diameter with respect to the column periphery.

The method may comprise providing that a foundation of curable material covers at least a portion of the base whereby the curable material of the column, the base, and the foundation are mechanically locked together.

Additional steps may comprise providing that a plurality of reinforcement members is mounted within the curable material within the foundation, the base, and the column.

The method may comprise providing that the outer periphery of the base is angled with respect to the column periphery within a range from five degrees to twenty-five degrees.

The method may comprise providing that a mold for the base is at least partially embedded within the foundation of curable material between the outer periphery of the base and the foundation.

The plurality of reinforcement members may comprise interconnected reinforcement members which extend through the foundation, the base, and substantially along a length of the column.

Another step may comprise providing that the foundation defines a receptacle which mates to at least a portion of the base.

In yet another embodiment, the structural support system may comprise a generally vertically extending column of curable material. A base of curable material may be monolithically formed with the column on its lower portion. The base comprises an outer periphery. A foundation of curable material comprises a foundation surface. The foundation defines therein a foundation receptacle below the foundation surface whereby the base extends into and conforms with the foundation receptacle. In other words, the outer periphery of the base may be shaped to conform to the foundation receptacle. The outer periphery of the base may or may not be angled with respect to the column periphery within a range from five degrees to twenty-five degrees. A plurality of reinforcement members may be mounted within the curable material within the foundation, the base, and the column.

The structural support system may or may not further comprise a mold for the base which is at least partially embedded within the foundation of curable material between the outer periphery of the base and the foundation receptacle.

In one possible embodiment, the foundation receptacle has an opening at the surface which is smaller in diameter than an outer diameter of at least a portion of the base which extends into the foundation receptacle, thereby locking the base within the foundation receptacle using curable material.

In yet another embodiment, a method for constructing a structural support may comprise steps such as creating a foundation form for a foundation, mounting a plurality of reinforcement members within the foundation form, mounting a column base form within the foundation form such that at least a portion of the column base form is below an anticipated surface of the foundation and/or pouring curable material into the foundation form whereby the column base creates a foundation receptacle within the foundation.

Other steps may comprise mounting a column form above the foundation in communication with the foundation receptacle within the foundation and pouring curable material into the column form to fill the column form and at least substantially fill the receptacle within the formation to create a column which extends into the foundation and at least substantially conforms with the foundation receptacle within the foundation.

The method may further comprising utilizing one or more of the plurality of reinforcement members for mounting the column base form within the form for the foundation.

The method may further comprise providing that the foundation receptacle has an opening at a surface of the foundation which is smaller in diameter than an outer diameter of at least a portion of the column which extends into the foundation receptacle thereby locking the column within the foundation.

The method may further comprise providing that when the column base form is mounted within foundation form, then the column base form comprises an outer surface which is angled with respect to the vertical within a range from five degrees to twenty-five degrees.

In one embodiment, the method further comprises embedding at least a portion of the column base form between the column and the foundation receptacle.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings, wherein like reference numerals refer to like parts and wherein.

It will be understood that the drawings are intended to show concepts of the invention, are not intended to be manufacturing drawings, and are therefore not necessarily to scale so that, as one example only, foundation 16 can be considerably thicker than shown.

DESCRIPTION OF THE PREFERRED EMBODIMENT

Figure 1:
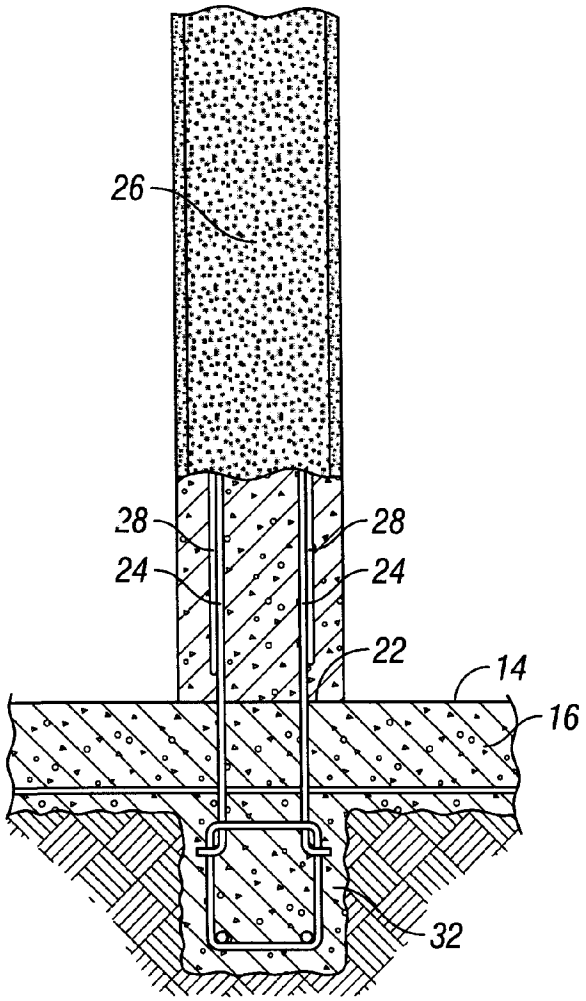
FIG. 1 (Prior Art)
FIG. 1 is an elevational view, partially in section, showing a vertical column built to stand on a cement slab.

Referring now to the drawings and, more particularly, to FIG. 1, there is shown column 26 with lower surface 22, which abuts against upper surface 14 of foundation 16. It will be appreciated that surface 14 of foundation 16 provides support for vertically downwardly directed forces on column 26. However, because upper surface 14 of foundation 16 and lower surface 22 of column 26 are flat abutting surfaces, these surfaces do not provide any significant inherent support for lateral, torsional, or upwardly directed forces, which may act on the column.

Instead, rebar 24 or other reinforcements are relied upon for this function. Rebar 24 is cemented into foundation 16 and extends upwardly. Rebar 24 may be cemented into column 26 to secure column 26 to foundation 16. Column 26 may also comprise rebar 28 which is secured to rebar 14. Instead of relying upon rebar 24, it would be desirable to provide that the cured material itself provide significant inherent support for lateral, torsional, or upwardly directed forces that may act on the column.

In one possible embodiment, foundation 16 may comprise beams, piers, or other downwardly directed foundation extensions 32 which may be of various types to increase the strength and integrity of foundation 16. The beams, piers, or other downwardly directed foundation extensions 32 may be laid out in beams or as a network that extends along a significant portion of foundation 16 or may be individual posts at various positions, and may have different cross-sections than those shown in the figures. As well, as mentioned hereinbefore, the relative dimensions are not necessarily intended to be to scale and may be quite different from that shown.

Figure 2:
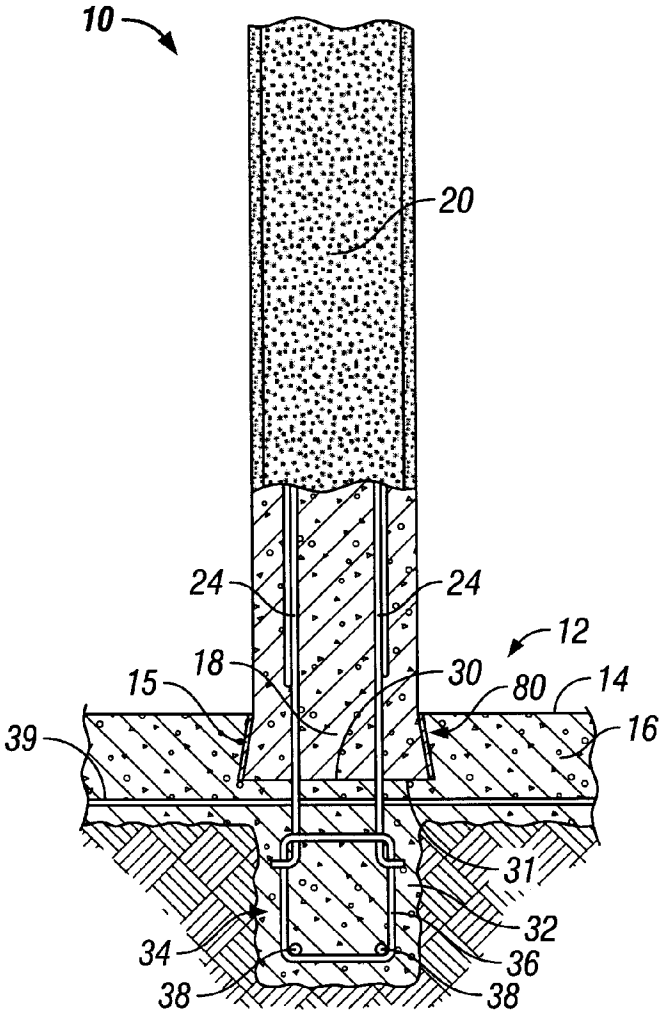
FIG. 2 is an elevational view, partially in section, showing a structural support of curable material monolithically formed with a dove-tailed base portion that is embedded within a foundation of curable material whereby the base and foundation are mechanically locked together in accord with one possible embodiment of the present invention.

In FIG. 2, there is shown one possible embodiment of structural support system 10 in accord with the present invention. Structural support system 10 includes recessed lower portion 12 which includes base 18 that extends beneath upper surface 14 of the foundation 16 into a mating receptacle within the interior of foundation 16 produced by form 80. The shape of base 18 and the corresponding shape of the receptacle in formation 16 may be created utilizing form 80. In one possible embodiment, form 80 may be embedded in the hardened material of column 20 between the mating surfaces of foundation 16 and base 18. Form 80 is discussed in more detail hereinafter.

Base 18 and column 20 are preferably monolithically formed of curable material such as but not limited to cement, concrete, resins, polymeric material and/or other curable materials. The curable material may be poured into a form or series of forms to harden over time into a shape that is consistent with the inner periphery of a column form as discussed in my previous applications referenced hereinbefore. In a preferred embodiment, base 18 and column 20 are poured or filled with curable material in the same pour to thereby form without interfaces or boundaries, i.e., so as to be monolithically formed together.

At the lower end, base 18 defines bottom surface 30, which engages mating surface 31 of foundation 16. The engagement of surface 30 against surface 31 provides support for vertically downward directed forces acting on column 20. In the embodiment of FIG. 2, bottom surface 30 is generally flat but could be variably shaped otherwise as desired. For example, mating grooves and ridges or the like might be provided in surfaces 30 and 31. In one embodiment, during pouring or cementing, the curable material which forms bottom surface 30 conforms to whatever is the shape of mating surface 31 formed in foundation 16. As discussed hereinbefore, mating surface 31 formed in foundation 16 may be cured prior to pouring curable material to form base 18 and bottom surface 30. Accordingly, foundation 16 provides support for vertically downward directed forces due to engagement of bottom surface 30 and mating surface 31. However, in accord with the present invention the curable material of foundation 16 also provides resistance to torsional, lateral, and/or upwardly directed vertical forces acting on column 20.

In this embodiment, base 18 has a dove tailed outer periphery which is interlocked with a mating surface of formation 16. In other words, foundation 16 defines a receptacle which conforms to the outer periphery of the base, whatever shape that may be. In the embodiment of FIG. 2, the receptacle in formation 16 defines an opening 15 at surface 14 of foundation 16 which is smaller in diameter than the outer diameter of at least a portion of base 18, which is shaped by form 80. Because the foundation receptacle and base outer periphery conform to each other, foundation 16 provides significant support for lateral, torsional, or upwardly directed forces which may act on column 20. In this embodiment, base 18 has a multi-sided frusto-pyramidal periphery which mates to a corresponding conforming receptacle formed within foundation 16. However, form 18 may have many different shapes, some of which are discussed herein.

Downwardly directed foundation extension 32 may comprise reinforcing materials. While rebar is shown in this embodiment, other types of reinforcing materials may be utilized including, but not limited to, those discussed hereinbefore. In this embodiment, a framework of rebar 34 is formed within downwardly directed foundation extension 32 which includes rebar loops such as rebar loop 36. Other rebar members 38 may be included and may run lengthwise or form loops as desired. In one embodiment, rebar 24 may be wrapped around rebar loop 36 and/or wrapped around other rebar loops. Other reinforcements such as rebar 39 and/or a network of rebar may also be provided in foundation 16 to run along the length thereof.

Figure 3:
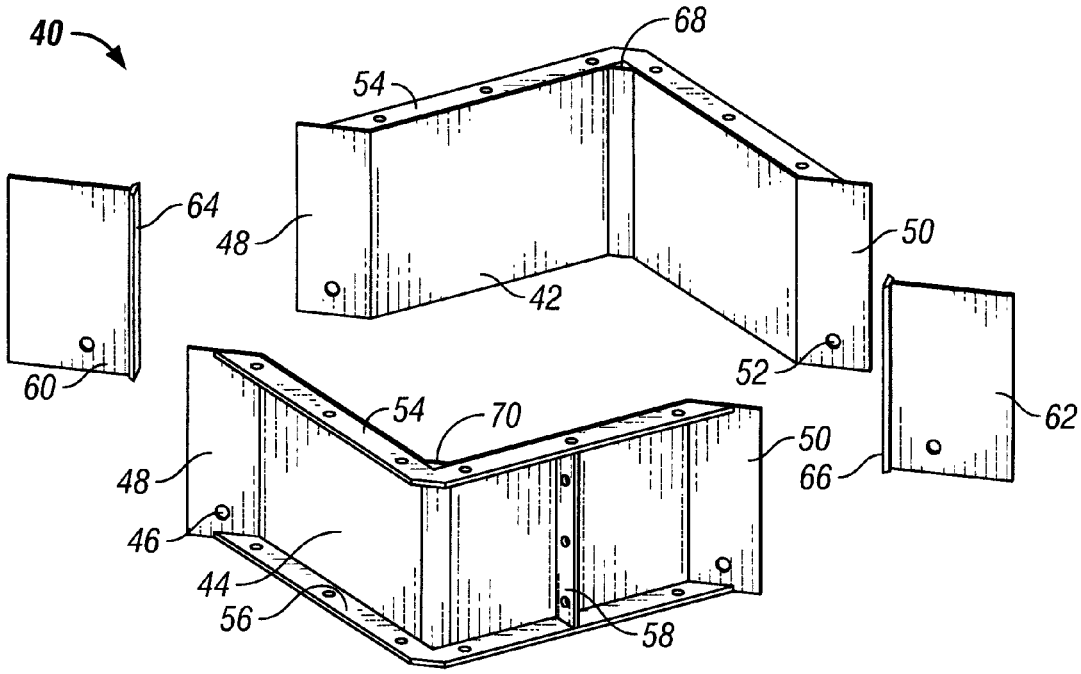
FIG. 3 is a perspective view, in exploded format, showing a form with two L-shaped components and two T-shaped inserts which may be utilized in the construction of a vertically extending column of curable material in accord with one possible embodiment of the present invention.

FIG. 3 shows an exploded view of one possible embodiment of form 40 for making vertically extending columns. Form 40 comprises shells which can be clamped together. In one embodiment, generally L-shaped shells 42 and 44 are clamped together utilizing fasteners to secure sets of flanges 48 and 50 together through openings in the flanges such as openings 46 and 52.

Upper and lower flanges on the L-shaped shells, such as upper flange 54 and lower flange 56 on shell 44 can be utilized to secure the shells to additional forms above and below. Side flanges, such as flange 58 provide additional integrity to the forms and permit form 40 to be secured to planks and other supports which may brace the forms in a vertical position during pouring and hardening of the curable material utilized in producing the vertically extending columns.

As explained in my previous applications, T-shaped elements 60 and 62 each produce a beveled edge on the finished column using surfaces 64 and 66, which are provided at the interior of form 40. The bevels so created will match bevels at 68 and 70 which are formed at the elbows of L-shaped shells 42 and 44. In one embodiment, the T-shaped elements comprise bolt holes in the surfaces thereof which when connected, will place surfaces 64 and 66 against the interior of L-shaped shells 42 and 44.

Figure 4:
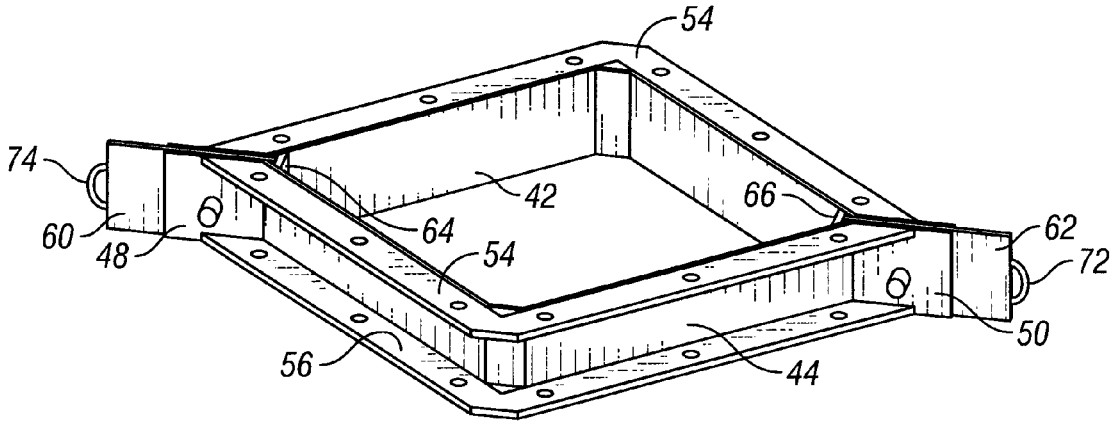
FIG. 4 is a perspective view showing an assembled form with two L-shaped components and two T-shaped inserts, which may be utilized in the construction of a vertically extending column of curable material in accord with another possible embodiment of the present invention.

In another embodiment, the T-shaped elements may be slidably mounted so that they can be pulled outwardly by ratchets or the like connected to loops 72 and 74 shown in FIG. 4. Bolts may be utilized within circular or elongate holes to tighten the T-shaped elements in position after ratcheting. This technique can be used to provide a tight seal along the edges of surfaces 64 and 66. FIG. 4 shows the elements of form 40 or elements of a similar form secured together.

The forms may vary in height and size, as desired, but are easily connected together at the upper and lower flanges. See, for example, some forms with different heights used on the column shown in FIG. 7.

Figure 8:
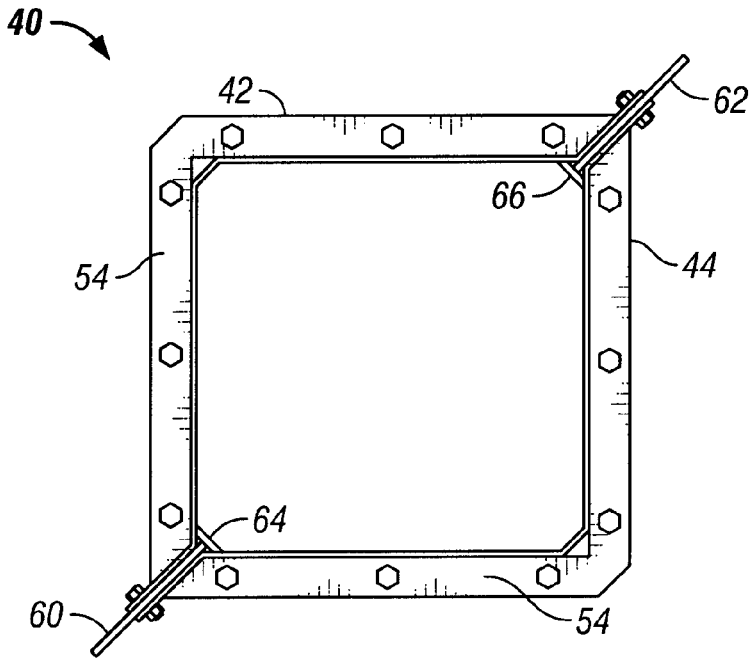
FIG. 8 is a top view showing an assembled form with two L-shaped components and two T-shaped inserts, which may be utilized in the construction of a vertically extending column of curable material in accord with another possible embodiment of the present invention.

FIG. 8 shows a top view of form 40. The interior of form 40 defines what will be the exterior of one possible embodiment of column 20, which in this case will be an octagon with four long sides and four short sides. However, the forms may have different inner shapes as desired. As discussed in my previous patent applications, the forms may be secured together at flanges 54.

Figure 5:
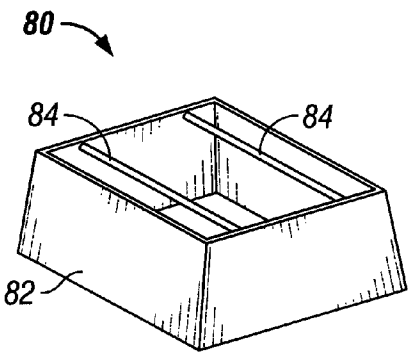
FIG. 5 is a perspective view which shows one possible shape of a base form which may be mounted prior to pouring a foundation for use in forming a base of a vertically extending column whereby the base and foundation are mechanically locked together in accord with one possible embodiment of the present invention.

FIG. 5 shows one possible embodiment of form 80. In this embodiment, form 80 has a four-sided frusto-pyramidal shape. However, form 80 may comprise cylindrical, conical, curved, stepped, irregular, many-sided, or other shaped surfaces as may be desired. Form 80 may comprise arms or legs which extend into foundation 16. As another example, form 80 might comprise a large substantially cylindrical or square base portion positioned on the end of base 18 which would be embedded within formation 16. However, form 80 is not limited to the above described shapes or any combination of the above shapes.

In one presently preferred embodiment, the four sides 82 are each angled with respect to the vertical (or with respect to the periphery of the column) in a range from five degrees to about twenty-five degrees. However, the invention is not limited to this range of angles and sides can be provided at angles greater than or less than this range. Moreover, the number of sides may vary and different sides may be symmetrical, unsymmetrical, and/or may vary in angle.

In the embodiment of FIG. 5, form 80 is open at the top and bottom. Support elements 84 may be provided within form 80 to allow form 80 to be secured within interior 90 (See FIG. 6) of the form for foundation 16, as discussed hereinafter. Form 84 may be comprised of any suitable materials such as metal, plastic, wood, and/or other desired materials, some of which are discussed herein and/or in my previous applications referred to hereinbefore.

Figure 6:
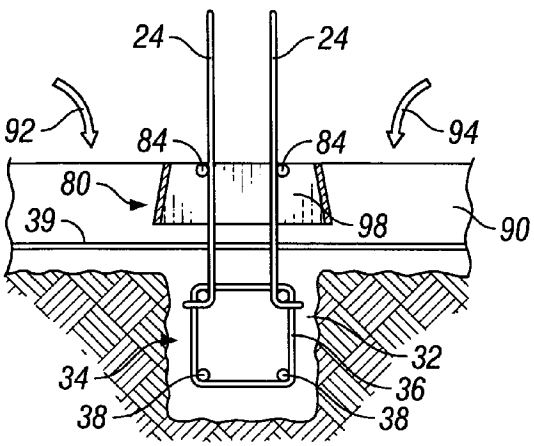
FIG. 6 is an elevational view, partially in section, showing the form of FIG. 5 mounted on rebar within the form of the foundation prior to the foundation being poured in accord with one possible embodiment of the present invention.

The interior 90 of the form for foundation 16 is shown in FIG. 6, prior to being filled with curable material by pouring as indicated by arrows 92 and 94. The form for foundation 16 is shown at least partially formed in the earth but may be formed with external forms and/or both. Reinforcements such as rebar may be added within interior 90 of the form for foundation 16, such as rebar framework 34, rebar loop 36, rebar loops 38, and/or the like, prior to pouring the curable material to create foundation 16.

Upwardly extending rebar 24 may be utilized to mount at least a portion of form 80 within interior 90 of the form for foundation 16. Support elements 84 may be connected to upwardly extending rebar 24 by ties, welding, or any suitable methods. While only two upwardly extending rebar 24 are shown, there may be any number, e.g., four or more.

However, mounting of form 80 at least partially within interior 90 may be accomplished in other ways. For example, form 80 may comprise rebar legs or the like that engage the earth or bottom of the form for foundation 16. In one embodiment, form 80 may be positioned so that the bottom extends about six or more inches beneath the surface of foundation 16, depending at least partially on the thickness of foundation 16.

Figure 7:
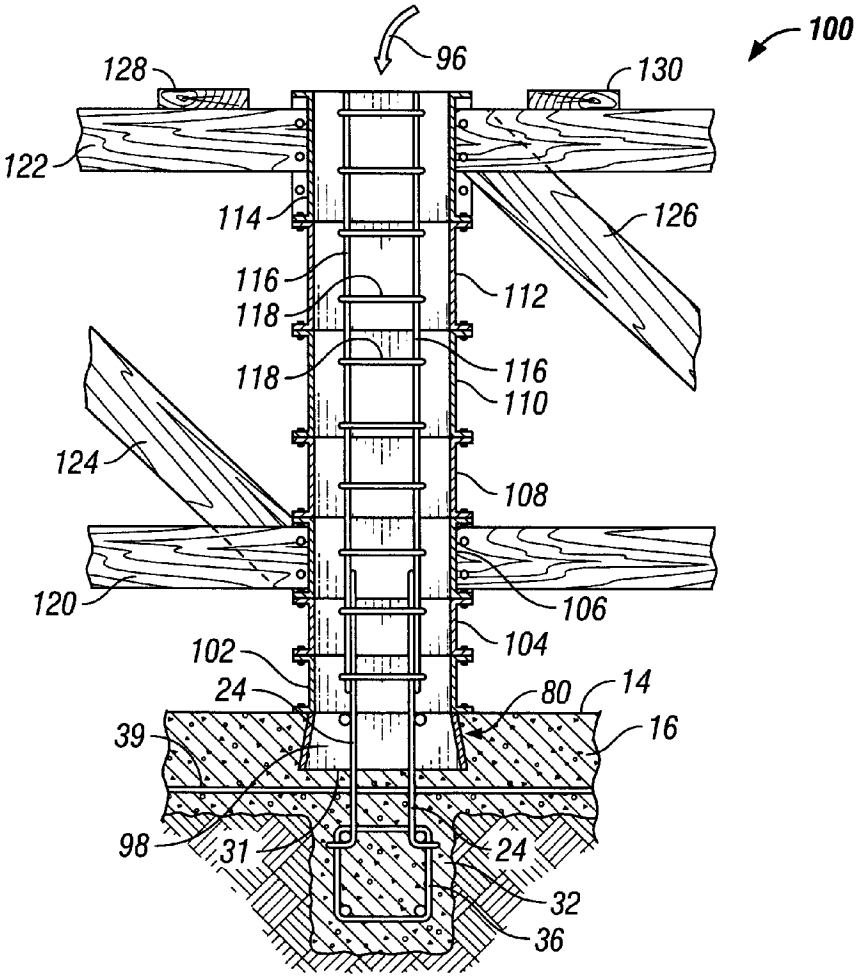
FIG. 7 is an elevational view, partially in cross-section, showing a form for a column prior to being poured with curable material and being mounted above a foundation with a base form that extends into the foundation in accord with one possible embodiment of the present invention.

In FIG. 7, the form for foundation 16 has been poured and given time to harden. Thus, the cured material of foundation 16 now surrounds form 80, which is now embedded within foundation 16. Interior 98 of form 80 preferably remains largely empty. Some curable material may flow into form 80 during pouring of foundation 16 but may also be removed and smoothed as desired. As well, the bottom of form 80 might be sealed or partially sealed with plastic material or the like with holes for upwardly extending rebar 24, if desired. Some curable material may be poured through form 80 to fill beams or piers such as downwardly directed foundation extension 32, if desired. The curable material may be spread and smoothed to form surface 14 at the desired level.

FIG. 7 shows a series of vertically disposed forms, such as those discussed hereinbefore in connection with FIG. 3 and FIG. 4 being mounted above foundation 16 prior to being filled with curable material by pouring as indicated by arrow 96. A first form 102 may be secured above form 80 utilizing bolts and flanges or other means. Subsequent forms 104, 106, 108, 110, 112, and 114 are then mounted on top of each other to provide form system 100 which is utilized to produce upwardly extending column 20. A network of reinforcing materials such as upwardly extending rebar 116 and laterally extending rebar may be positioned within form system 100 and may extend partially, substantially, or entirely along the height thereof, if desired. This reinforcing material may be connected to upwardly extending rebar members 24, which are cemented within the cured material of foundation 16, by ties, welding, or the like. It will be noted that the forms may have different heights as desired.

Figure 9:
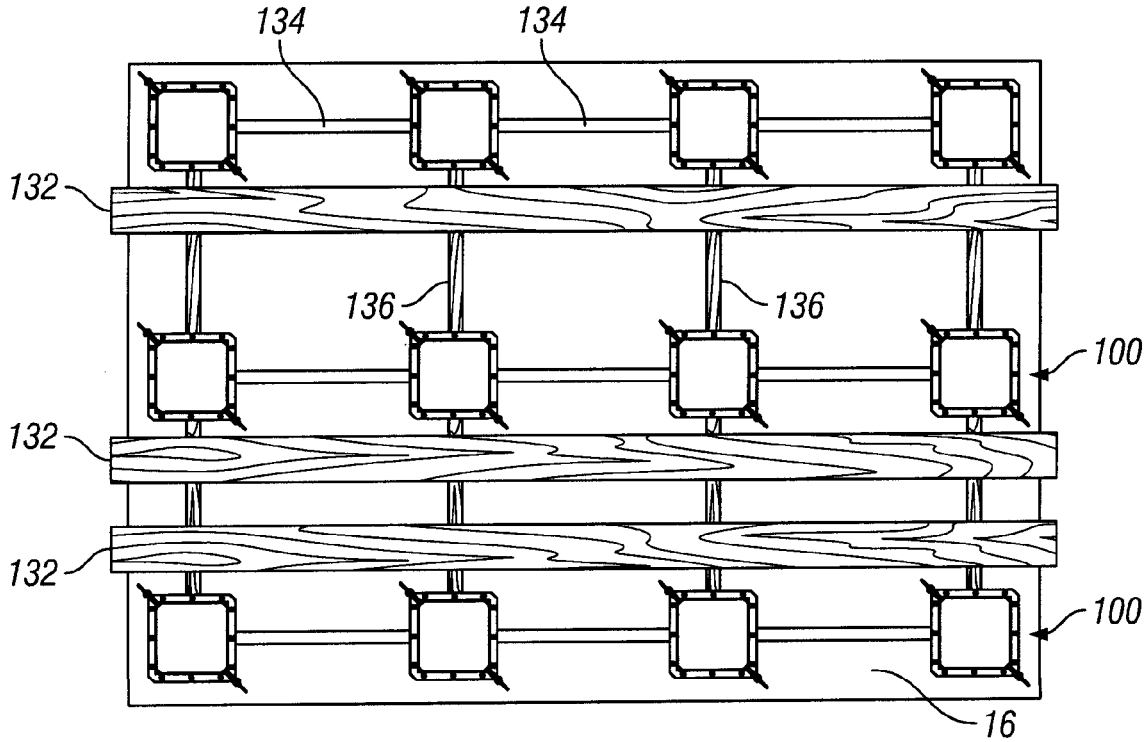
FIG. 9 is a top view showing forms such as those of FIG. 8 for a plurality of vertically extending columns mounted over a foundation in accord with one possible embodiment of the present invention.

Forms 106 and 114 provide flanges to which wood beams may be attached to brace each form system 100 in place. Supports such as horizontal wood beams 120 and 122 may be utilized to brace a plurality of form systems 100, as indicated in FIG. 9. The wood beams may be angled as indicated by beams 124 and 126. Other wood beams or other types of supports such as supports 128 and 130 may also be utilized to secure all of the plurality of form systems 100 together prior to pouring.

FIG. 9 shows a plurality of form systems 100 in position on foundation 16 to receive curable material. In this embodiment horizontal boards 134 and vertical boards 136 (as seen from the top) are connected with the form systems 100 as discussed hereinbefore to form a grid. In this embodiment, the form systems are braced by wooden boards such as boards 132 which are connected to other braces. Other types of braces such as tubulars or the like may also be utilized.

In operation, a form for foundation 16 is created as indicated in FIG. 6. The reinforcement members such as rebar may then be added, preferably with upwardly extending rebar members such as rebar 24. There may be any desired number of upwardly extending rebar members such as four, six, eight or the like. The rebar may be secured together by ties, welding, or other means as desired.

Form 80 may then be inserted over the upwardly extending rebar members 24, assuming upwardly extending rebar members 24 are utilized. Form 80 is then mounted in a desired position within the interior of the form for foundation 16 such that at least a portion of form 80 extends into an interior of foundation 16 below the anticipated surface of the foundation. Form 80 may be secured to upwardly extending rebar members 24 by ties, welding or the like to supports 84 within form 80. However, form 80 may be mounted on legs that may comprise rebar. Form 80 might also be mounted to other reinforcement materials using any suitable means. Curable material may then be poured into the form for foundation 16 whereby form 80 is cemented into the formation 16 such that an outer surface of form 80 defines a receptacle for base 18 of column 20 within foundation 16. The surface 31 (See FIG. 7) of the curable material in form 80 may be smoothed over and adjusted in height or otherwise textured if desired before the material cures. Likewise, surface 14 of the foundation may be smoothed with the cement poured to provide the desired height.

For the form shown in FIG. 5, it will be appreciated that the receptacle created within foundation 16 will be shaped to receive a four-walled frusto-pyramidal shape that matches to the corresponding shape of column base 18. It will be appreciated that the surfaces of this receptacle would resist torsional, lateral, or upwardly directed forces applied to the surfaces of the correspondingly sized column base 18 once the mating structure of base 18 is formed. As noted above, many different possible shapes are possible for form 80. It would be possible to make form 80 out of breakable material and remove form 80 but in one preferred embodiment form 80 is left in place after curing.

After sufficient curing of the material for foundation 16, any desired number of form systems 100 may be built on top of form 80 as shown in FIG. 7 and FIG. 9. Rebar or other reinforcements may be provided along the length of the columns and attached to any rebar or other reinforcements which extend upwardly from the foundation. The rebar or other reinforcements may be attached as the individual forms of form system 100 are being put together. As well, bracing of the forms may be utilized as shown in FIG. 7 and FIG. 9. Once prepared and braced, curable material may be pumped, poured, or the like into the top of column form systems 100 as indicated by arrow 96. However, it will be understood that curable material may be pumped by any suitable piping or other means into either column form systems 100 or the forms for foundation 16. The above process essentially provides for two basic pourings of the foundation and the columns with the columns being poured after curing of the foundation. In this way, there are little or few discontinuities created in the curable material so that the formation is considered to be monolithically formed of curable material, and the column is considered to be monolithically formed of curable material. In other words, if the curable material is poured and cured then the resulting structure is considered to be monolithically formed in the present invention. However, if desired, multiple pours may be utilized for either the columns and/or for the foundation.

Many additional changes in the details, components, steps, and organization of the system, herein described and illustrated to explain the nature of the invention, may be made by those skilled in the art within the principle and scope of the invention. It is therefore understood that within the scope of the appended claims, the invention may be practiced otherwise than as specifically described.

What is claimed is:

1. A structural support system comprising:

a generally vertically extending column of curable material, said column having a column periphery;

a base of curable material monolithically formed with said column on its lower portion, said base having an outer periphery that varies with respect to said column periphery;

a foundation of curable material formed over at least a portion of said base and having a monolithic portion thereof, underlying said base, whereby said column, said base, and said foundation are mechanically locked together; and a plurality of reinforcement members disposed within said curable material within said foundation, said base, and said column.

2. The structural support system of claim 1, wherein said outer periphery of said base is angled with respect to said column periphery within a range from five degrees to twenty-five degrees.

3. The structural support system of claim 1 further comprising a mold for said base which is at least partially embedded within said foundation of curable material between said outer periphery of said base and said foundation.

4. The structural support system of claim 1 wherein said plurality of reinforcement members comprise interconnected reinforcement members which extend through said foundation, said base, and substantially along a height of said column.

5. The structural support system of claim 1 wherein said foundation defines a receptacle which has a shape which mates to and interlocks with a corresponding shape of said at least a portion of said base, said shape being configured to thereby resist torsional, lateral, and upwardly directed vertical forces acting on said column.

6. A method for constructing a structural support comprising:

providing a generally vertically extending column of curable material wherein said column comprises a column periphery;

providing a base of curable material monolithically formed with said column on its lower portion, and providing that said base comprises an outer periphery that varies in diameter with respect to said column periphery;

providing that a foundation of curable material covers at lower portion of said base and has a monolithic portion thereof, which underlies said base, whereby said curable material of said column, said base, and said foundation is mechanically locked together; and providing that a plurality of reinforcement members are mounted within said curable material within said foundation, said base, and said column.

7. The method of claim 6, comprising providing that said outer periphery of said base is angled with respect to said column periphery within a range from five degrees to twenty-five degrees.

8. The method of claim 6 further comprising providing that a mold for said base is at least partially embedded within said foundation of curable material between said outer periphery of said base and said foundation.

9. The method of claim 6 further comprising providing that said plurality of reinforcement members extend through said foundation, said base, and along a height of said column.

10. The method of claim 6 further comprising providing that said foundation defines a receptacle which mates to and interlocks with a corresponding shape of said at least a portion of said base, and providing that said shape is configured to resist torsional, lateral, and upwardly directed vertical forces acting on said column.

11. A structural support system comprising:

a generally vertically extending column of curable material, said column having a column periphery;

a base of curable material monolithically formed with said column on its lower portion, said base comprising an outer periphery;

a foundation of curable material comprising a foundation surface, said foundation defining therein a foundation receptacle below said foundation surface whereby said base extends into said foundation receptacle, said outer periphery of said base being shaped so as to conform to said foundation receptacle, said foundation having a monolithic portion thereof, underlying said base; and a plurality of reinforcement members mounted within said curable material within said foundation, said base, and said column.

12. The structural support system of claim 11, wherein said outer periphery of said base is angled with respect to said column periphery within a range from five degrees to twenty-five degrees.

13. The structural support system of claim 11 further comprising a mold for said base which is at least partially embedded within said foundation of curable material between said outer periphery of said base and said foundation receptacle.

14. The structural support system of claim 11 wherein said foundation receptacle has an opening at said foundation surface which is smaller in diameter than an outer diameter of at least a portion of said base, said base thereby being mechanically locked within said foundation by said curable material.

15. A method for constructing a structural support comprising:

creating a foundation form for a foundation;

mounting a plurality of reinforcement members within said foundation form;

mounting a column base form within said foundation form such that at least a portion of said column base form is below an anticipated surface of said foundation;

pouring curable material into said foundation form whereby said column base creates a foundation receptacle within said foundation;

mounting a column form above said foundation in communication with said foundation receptacle within said foundation; and pouring curable material into said column form to fill said column form and said receptacle within said foundation to create a column and a column base which extends into said foundation and wherein said column base at least substantially conforms with said foundation receptacle within said foundation and wherein a monolithic portion of said foundation, underlies said base.

16. The method of claim 15 further comprising utilizing one or more of said plurality of reinforcement members for mounting said column base form within said foundation form.

17. The method of claim 15 further comprising providing that said foundation receptacle has an opening at a surface of said foundation which is smaller in diameter than an outer diameter of at least a portion of said column base which extends into said foundation receptacle.

18. The method of claim 15 further comprising providing that when said column base form is mounted within foundation form, said column base form comprises an outer surface which is angled with respect to the vertical within a range from five degrees to twenty-five degrees.

19. The method of claim 15 further comprising embedding at least a portion of said column base form between a periphery of said column base and said foundation receptacle.

* * * * *